US008245421B2

(12) United States Patent
Baudouin et al.

(10) Patent No.: US 8,245,421 B2
(45) Date of Patent: Aug. 21, 2012

(54) CLOSURE SYSTEMS FOR ARTICLES OF FOOTWEAR

(75) Inventors: Alexandre Baudouin, Portland, OR (US); Michael R. Friton, Portland, OR (US); John Hurd, Tigard, OR (US); Casey Lee Smith, Oregon City, OR (US)

(73) Assignee: Nike, Inc., Beaverton, OR (US)

( * ) Notice: Subject to any disclaimer, the term of this patent is extended or adjusted under 35 U.S.C. 154(b) by 580 days.

(21) Appl. No.: 12/417,724

(22) Filed: Apr. 3, 2009

(65) Prior Publication Data

US 2010/0251572 A1 Oct. 7, 2010

(51) Int. Cl.
*A43B 21/00* (2006.01)
*A43B 11/00* (2006.01)

(52) U.S. Cl. ..... 36/103; 36/105; 36/58.6

(58) Field of Classification Search ..... 36/102, 36/103, 138, 105, 58.5, 58.6, 97
See application file for complete search history.

(56) References Cited

U.S. PATENT DOCUMENTS

| | | | | |
|---|---|---|---|---|
| 171,301 | A | 12/1875 | McKee | |
| 474,574 | A | 5/1892 | Bruzon | |
| 537,627 | A | 4/1895 | Bixby et al. | |
| 955,337 | A | 4/1910 | Lawlor | |
| 2,450,250 | A | 9/1948 | Napton | |
| 2,452,502 | A | 10/1948 | Tarbox | |
| 2,452,649 | A | 11/1948 | Graves | |
| 2,829,448 | A | 4/1958 | Minera | |
| 2,920,402 | A | 1/1960 | Minera | |
| 4,095,356 | A | 6/1978 | Robran et al. | |
| 4,507,879 | A | 4/1985 | Dassler | |
| 4,559,724 | A | 12/1985 | Norton | |
| 4,573,457 | A * | 3/1986 | Parks | 602/29 |
| 4,581,831 | A * | 4/1986 | Kirsch | 36/117.9 |
| 4,944,099 | A | 7/1990 | Davis | |
| 5,184,410 | A | 2/1993 | Hamilton | |

(Continued)

FOREIGN PATENT DOCUMENTS

DE 1931800 A1 3/1970

(Continued)

OTHER PUBLICATIONS

International Search Report and Written Opinion issued Jun. 28, 2010 in corresponding PCT Application No. PCT/US2010/029621.

*Primary Examiner* — Jila Mohandesi
(74) *Attorney, Agent, or Firm* — Banner & Witcoff, Ltd.

(57) ABSTRACT

An article of footwear including a forefoot portion and a heel portion movable relative to the forefoot portion from a first articulated configuration to a second articulated configuration is provided. An articulation assembly having a forefoot articulation member and a heel articulation member is also provided. The articulation assembly couples the forefoot portion to the heel portion and includes a hinge mechanism and a cam mechanism. The hinge mechanism may include a pin located within a socket. The cam mechanism may include a cam surface and a protrusion configured to ride on the cam surface. The article of footwear may include a locking mechanism having a first locking element that engages a second locking element in the first articulated configuration. The first locking element may be a first concavity formed in a surface and the second locking element may be a protrusion configured to extend into the first concavity in the first articulated configuration. The articulation assembly may be provided as part of a sole structure.

49 Claims, 10 Drawing Sheets

U.S. PATENT DOCUMENTS

| | | | | |
|---|---|---|---|---|
| 5,282,327 | A | 2/1994 | Ogle | |
| 5,471,769 | A | 12/1995 | Sink | |
| 5,481,814 | A | 1/1996 | Spencer | |
| 6,189,239 | B1 | 2/2001 | Gasparovic et al. | |
| 6,594,921 | B2 * | 7/2003 | Laio et al. | 36/138 |
| 6,684,533 | B1 | 2/2004 | Su | |
| 7,059,069 | B2 | 6/2006 | Raluy et al. | |
| 7,284,341 | B2 | 10/2007 | Moseley | |
| 7,793,438 | B1 * | 9/2010 | Busse et al. | 36/105 |
| 2002/0178616 | A1 * | 12/2002 | Williams | 36/97 |

FOREIGN PATENT DOCUMENTS

| | | |
|---|---|---|
| NL | 1020208 | 9/2003 |
| WO | 2009014433 A1 | 1/2009 |

* cited by examiner

CLOSURE SYSTEMS FOR ARTICLES OF FOOTWEAR

FIELD OF THE INVENTION

The present invention relates to articles of footwear and closure systems for articles of footwear. More particularly, various examples of the invention relate to articulation assemblies and articulated sole assemblies for articles of footwear.

BACKGROUND OF THE INVENTION

A conventional article of footwear includes two primary elements, an upper and a sole structure. The upper provides a covering for the foot that securely receives and positions the foot with respect to the sole structure. The sole structure is secured to a lower portion of the upper and is positioned between the foot and the ground. The sole structure may attenuate ground reaction forces, provide traction and control foot motions.

The uppers of many articles of footwear, including most articles of athletic footwear, include a forefoot portion and a heel portion. These uppers generally include an opening that may be enlarged to receive a foot and then reduced or tightened to assist in the retention of the article of footwear to the foot. A variety of closure systems are used to enlarge and reduce the foot-receiving opening.

One typical closure system for an upper consists of an elongated opening having laces that may be used to pull together opposing edges of a portion of the elongated opening. Straps or buckles may be used in lieu of laces. Another typical closure system uses one or more elastic gores (or other elastic elements) that stretch during the insertion of the foot into the article of footwear. These closure systems require manipulation by a user, for example, by loosing or tightening the laces or by stretching the elastic, to provide for foot insertion, to provide for foot retention and/or to release the foot.

An example of another type of closure system is described in U.S. Pat. No. 6,189,239 to Gasparovic et al. The shoe includes a forefoot portion and a rear portion that are joined by a flexure member in the midfoot region of the sole. The forefoot portion and the rear portion of the upper are separate assemblies. In order to insert a foot into the shoe, the rear portion of the shoe is flexed downward relative to the forefoot portion, thereby providing an opening for the foot to slide into the forefoot portion. The rear portion of the shoe is then rotated back into alignment with the forefoot portion, thereby enclosing the heel of the foot. A strap is used to connect and secure the upper's heel portion to the upper's forefoot portion. This closure system has the same disadvantage as the above-described closure systems, as it too requires manipulation by a user, for example, by connecting and securing the strap across the rear and forefoot portions, in order to provide for foot insertion, foot retention and/or foot release.

As another example, a shoe is divided into front and back parts which are hinged together at the shoe sole. U.S. Pat. No. 5,481,814 to Spencer discloses that the hinge may comprise a creased part of the sole, preferable the outsole, or a separate mechanical hinge element. Additionally, a spring or a rigid element (with resilient anchoring points) extends across the hinge line to assist in retaining the shoe in the open and in the closed position. The spring or rigid element lies on one side of the hinge line in the open position and lies on the opposite side of the hinge line in the closed position. One disadvantage of this design is the requirement of a fairly long spring or rigid element that is necessary to provide the biasing function. The exposed recess for the spring or rigid element also would tend to collect dirt, mud, or other debris, thereby undesirably increasing the weight of the footwear. These hardware items also may tend to catch on other objects on the ground, thereby causing safety issues.

Although it is recognized that certain articles of footwear, such as clogs, mules, flip-flops, etc., have an opening for receiving the foot that is not enlarged/reduced, these articles of footwear are typically not securely held to the heel of the foot. Thus, these loosely-secured articles of footwear are not suitable for use in situations where the article of footwear must be reliably and securely attached to the foot. Additionally, for many of these loosely-secured articles of footwear, the upper does not include a heel portion.

It would be desirable to provide a closure system for an article of footwear that would not require the use of hands to secure the article of footwear to a foot. Further it would be desirable to provide a closure system that overcomes the disadvantages discussed above.

BRIEF SUMMARY OF THE INVENTION

Various aspects of this invention relate to closure systems having articulated sole elements. Some aspects of the invention relate to footwear having such articulated sole elements.

According to one aspect of the invention, an article of footwear having an articulated sole may be provided. The article of footwear includes a forefoot portion and a heel portion movable relative to the forefoot portion from a first articulated configuration to a second articulated configuration. The article of footwear further includes an articulation assembly having a forefoot articulation member and a heel articulation member. The articulation assembly, which couples the forefoot portion to the heel portion, may include a hinge mechanism and a cam mechanism.

In one aspect, the heel articulation member may be rotatably coupled to the forefoot articulation member. In another aspect, the heel articulation member may be rotatably and translationally coupled to the forefoot articulation member.

The cam mechanism may include a cam surface provided by the forefoot articulation member or the heel articulation member. The cam mechanism further may include a protrusion provided by the other of the forefoot articulation member and the heel articulation member. In one aspect, the protrusion may be configured to ride on the cam surface when the heel portion moves between the first and the second articulated configurations. The term "ride," as used herein, means to contact and follow the contour. Thus, for example, rolling and/or sliding may be performed by an element as it "rides" on a surface. Optionally, the cam surface may include at least first and/or second depressions or concavities configured to receive the protrusion when the first articulation member is in the first and second articulated configurations, respectively.

The hinge mechanism may include a socket provided by the forefoot articulation member or the heel articulation member. The hinge mechanism further may include a pin provided by the other of the forefoot articulation member and the heel articulation member. In one aspect, the pin may be rotatably located in the socket. In another aspect, the pin may be both rotatably located in the socket and transversely-movably located in the socket. In this aspect, the hinge mechanism may include a socket having a non-circular cross-section.

The article of footwear may further include a resilient biasing element configured to bias the heel portion relative to the forefoot portion. In one aspect, a biasing element may be provided by the articulation assembly and may be configured to ride on the cam surface.

In one aspect, the articulation assembly may be entirely located between an upper surface of the article of footwear's sole structure and a ground-contacting surface of the sole structure.

In another aspect, the article of footwear may include an anchoring element extending from a forefoot sole to a heel upper. The anchoring element may stabilize and/or limit movement of the heel portion relative to the forefoot portion. Additionally, the anchoring element may be a biasing element.

In even a further aspect, the article of footwear may include a locking mechanism having a first locking element provided on a surface and a second locking element. The second locking element may be configured to engage the first locking element when the heel portion is in the first articulated configuration. The force required to disengage the second locking element from the first locking element, thereby disengaging the second locking element from the first articulated configuration, may be greater than the force required to move the second locking element between the first articulated configuration and the second articulated configuration. The second locking element may be configured to ride on the surface during movement of the heel portion between the first and the second articulated configurations. In one aspect, the first locking element may be a first concavity and the second locking element may be a protrusion configured to extend into the first concavity in the first articulated configuration.

According to one aspect of the present invention, an article of footwear may include a forefoot portion, a heel portion and a sole structure. The heel portion may be moveable relative to the forefoot portion from a first articulated configuration to a second articulated configuration. The sole structure may extend from the heel portion to the forefoot portion and have an upper surface and a lower surface. A hinge mechanism may join the forefoot portion to the heel portion. The upper and lower surfaces of the sole structure may extend over the hinge mechanism and join the forefoot portion to the heel portion.

According to an aspect of the present invention, an articulation assembly for an article of footwear may be provided. The articulation assembly includes a forefoot articulation member and a heel articulation member, with the heel articulation member being movable relative to the forefoot articulation member from a first articulated configuration to a second articulated configuration. The articulation assembly further may include a hinge mechanism and a cam mechanism. The articulation assembly may further include a locking mechanism.

In even another aspect of the present invention, a sole structure for an article of footwear having a forefoot sole portion, a heel sole portion and an articulation assembly may be provided. The forefoot sole portion and the heel sole portion may form a continuous sole portion having either a continuous ground-contacting sole element or a continuous midsole element. The articulation assembly may include a cam mechanism and a locking mechanism.

According to a further aspect of the present invention, a method is provided of donning an article of footwear having a forefoot portion, a heel portion movable relative to the forefoot portion between a first articulated configuration and a second articulated configuration, and an articulation assembly having a forefoot articulation member, a heel articulation member, a hinge mechanism and a cam mechanism. The method may include placing a forefoot within the forefoot portion and articulating the heel portion relative to the forefoot portion. The step of articulating may include rotating the heel portion relative to the forefoot portion around a hinge element and sliding a protrusion on a cam surface. The method may further include aligning a sole of the heel portion with a sole of the forefoot portion and locating the protrusion in a first concavity. Optionally, the method further may include disengaging a first locking element from a second locking element. In certain aspects, the method may include biasing the heel portion relative to the forefoot portion during the step of articulating and/or translating the heel portion relative to the forefoot portion during the step of articulating.

BRIEF DESCRIPTION OF THE DRAWINGS

The foregoing Summary, as well as the following Detailed Description, will be better understood when read in conjunction with the accompanying drawings.

Figure 1:
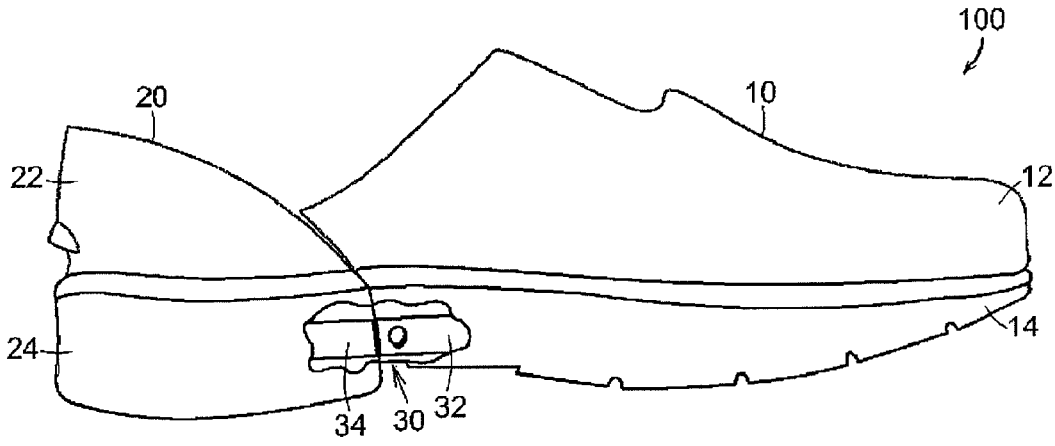
FIG. 1 is a schematic side elevation view of an article of footwear in a first, closed configuration, with a cut-away showing a detail of an articulation mechanism, according to an aspect of the present invention.

The figures referred to above are not necessarily drawn to scale, should be understood to provide a representation of particular aspects of the invention, and are merely conceptual in nature and illustrative of the principles involved. Some features of the article of footwear depicted in the drawings may have been enlarged or distorted relative to others to facilitate explanation and understanding. The same reference numbers are used in the drawings for similar or identical components and features shown in various alternative aspects. Articles of footwear as disclosed herein would have configurations and components determined, in part, by the intended application and environment in which they are used.

DETAILED DESCRIPTION OF THE INVENTION

The following discussion and accompanying figures disclose an articulated sole and an article of footwear having an articulated sole in accordance with various aspects of the present invention. Although concepts related to the sole are disclosed with reference to an article of athletic footwear, the sole is not limited to use with footwear designed for athletic activities. Thus, the sole according to various aspects of the invention may be incorporated into footwear that is generally considered to be non-athletic, including a variety of dress shoes, casual shoes, sandals, and boots.

Figure 2:
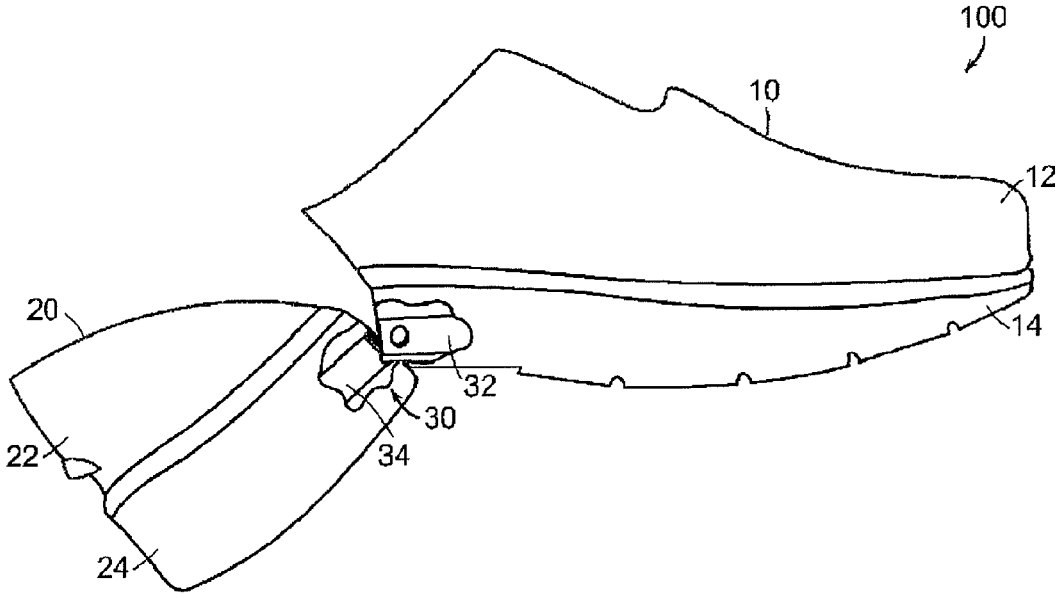
FIG. 2 is a schematic side elevation view of the article of footwear of FIG. 1 in a second, open configuration.

The present invention may be embodied in various forms. One aspect of an article of footwear 100 is shown in FIGS. 1 and 2. For purposes of general reference, footwear 100 may be divided into two general portions: a forefoot portion 10 and a heel portion 20. Portions 10 and 20 are not intended to demarcate precise areas of footwear 100. Rather, portions 10 and 20 are intended to represent general areas of footwear 100 that provide a frame of reference during the following discussion. By way of non-limiting example, forefoot portion 10 may longitudinally extend over approximately 20% to 95% of the length of the article of footwear 100. Correspondingly, heel portion 20 may longitudinally extend over approximately 5% to 70% of the length of the article of footwear. More typically, forefoot portion 10 may extend over approximately 50% to 80% of the length of the article of footwear, and heel portion may extend the remaining 20% to 50% of the length. Generally, forefoot portion 10 receives the forefoot portion of a foot of a wearer and heel portion 20 receives the heel of the foot.

Forefoot portion 10 includes a forefoot upper 12 and a forefoot sole assembly 14 secured to forefoot upper 12. Forefoot sole assembly 14 may be secured to forefoot upper 12 by an adhesive, or any other suitable fastening means, including, for example, stitching, sewing, laser welding, fusing techniques, mechanical connectors, etc. Forefoot upper 12 assists in retaining footwear 100 to the forefoot of a wearer. Forefoot sole assembly 14, which is disposed between the foot of the wearer and the ground, provides attenuation of ground reaction forces, traction, and may assist in controlling foot motions, such as pronation.

Similarly, heel portion 20 includes a heel upper 22 and a heel sole assembly 24 secured to upper 22. Heel sole assembly 24 may be secured to heel upper 22 by an adhesive, or any other suitable fastening means, including, for example, stitching, sewing, laser welding, fusing techniques, mechanical connectors, etc. Heel upper 22 assists in retaining footwear 100 to the heel of a wearer. Heel sole assembly 24, which is also disposed between the foot of the wearer and the ground, provides attenuation of ground reaction forces, traction, and may also assist in controlling foot motions, such as pronation.

The sole structures of many articles of footwear, particularly athletic footwear, generally exhibit a layered configuration that may include a comfort-enhancing insole, a resilient midsole, and a ground-contacting outsole that provides both abrasion-resistance and traction. The insole typically is a thin, compressible member located within the upper and adjacent to a plantar (i.e., lower) surface of the foot to enhance footwear comfort (it may also be called a "sock liner"). The midsole is generally the primary sole structure element that attenuates ground reaction forces and controls foot motions. For example, the midsole may compress resiliently under an applied load to attenuate ground reaction forces created by the impacts of running and jumping. The outsole forms the ground-contacting element of footwear and is usually fashioned from a durable, wear-resistant material, such as a carbon-black rubber compound, that may include texturing to improve traction. The relative heights of the sole structures of the heel and forefoot portions need not be the same.

As with conventional articles of footwear, sole assemblies 14, 24 may include one or more of an insole, a midsole and an outsole (not shown). Thus, for example, in certain aspects, sole assemblies 14, 24 need not include in insole. In other aspects, the outsole may not be separate from the midsole, but, rather, the outsole may comprise a bottom surface of the midsole that provides the external traction surface of sole assemblies 14 and 24. In even other aspects, sole assembly 14 may differ from sole assembly 24. By way of non-limiting example, sole assembly 14 may have a midsole formed as a single piece of a polyurethane foam, whereas sole assembly 24 may have a midsole formed of multiple shock-attenuating and energy-absorbing components or other support assemblies, such as plural impact force absorbing columns, one or more fluid-filled bladders, etc.

Article of footwear 100 further includes an articulation assembly 30. In FIGS. 1 and 2, portions of the sole assemblies 14, 24 are cut away so that a portion of articulation assembly 30 may be viewed. A first articulated member 32 of articulation assembly 30 may be positioned within forefoot sole assembly 14 and second articulated member 34 of articulation assembly 30 may be positioned within heel sole assembly 24. First articulated member 32 may be hingeably or rotatably attached to second articulated member 34. Thus, as best seen by comparing FIG. 1 with FIG. 2, articulation assembly 30 allows heel portion 20 to be articulated relative to forefoot portion 10 (or vice versa).

Figure 3:
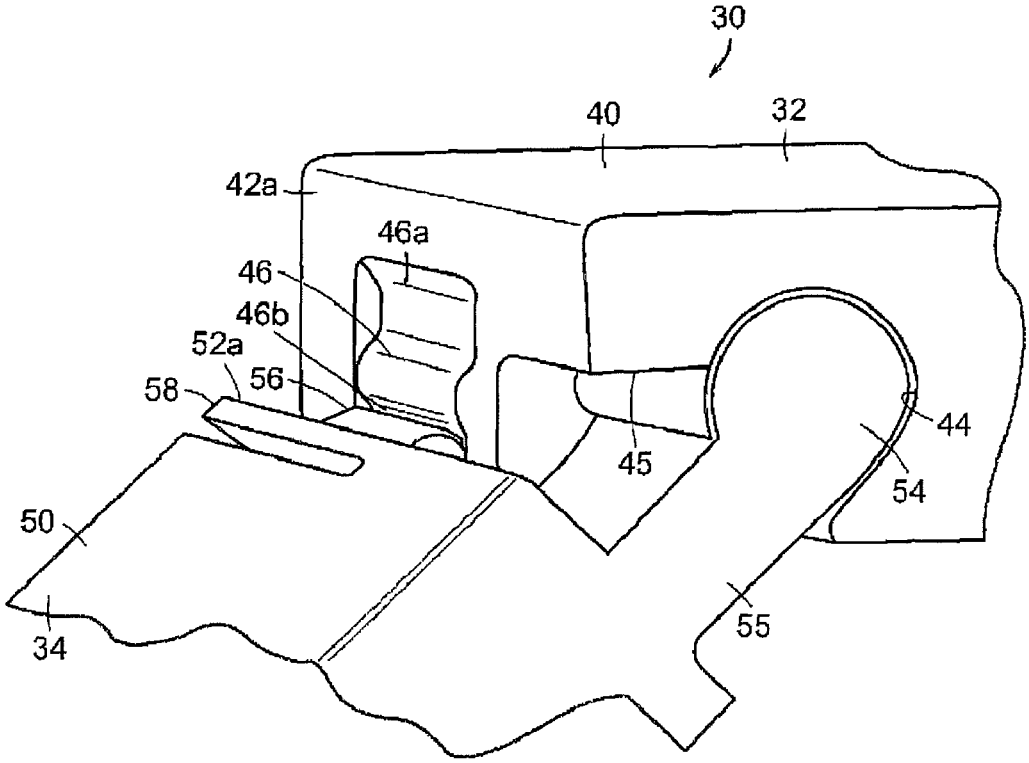
FIG. 3 is a schematic perspective view of a portion of a socket-side element of an embodiment of an articulation mechanism according to an aspect of the present invention.
Figure 4:
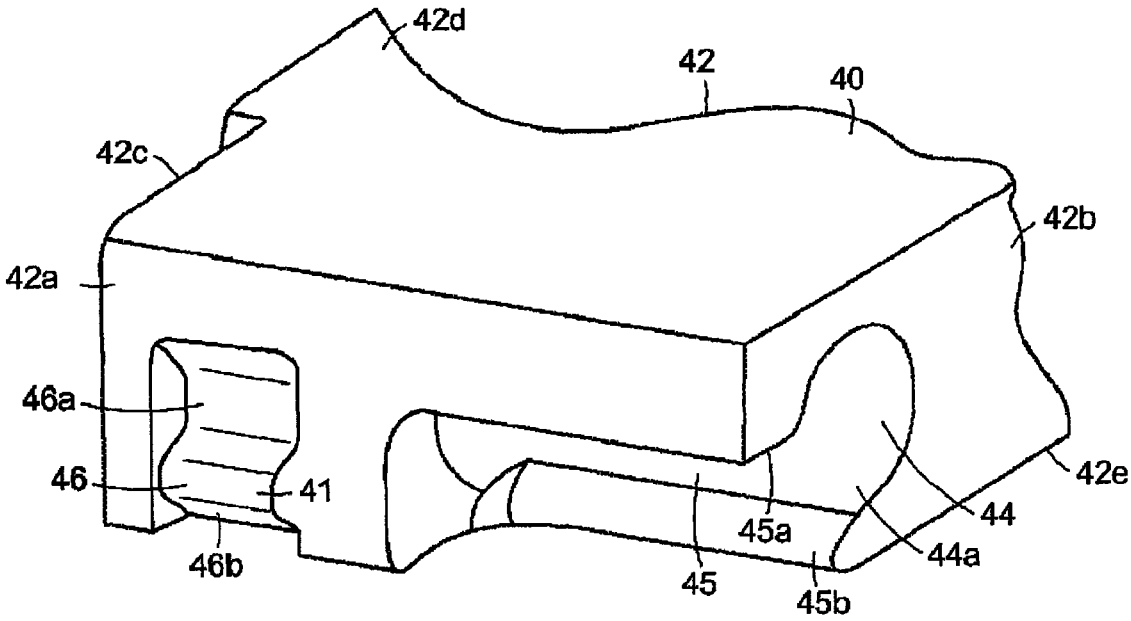
FIG. 4 is a schematic perspective view of a portion of a pin-side element of embodiment of an articulation mechanism according to an aspect of the present invention.
Figure 5:
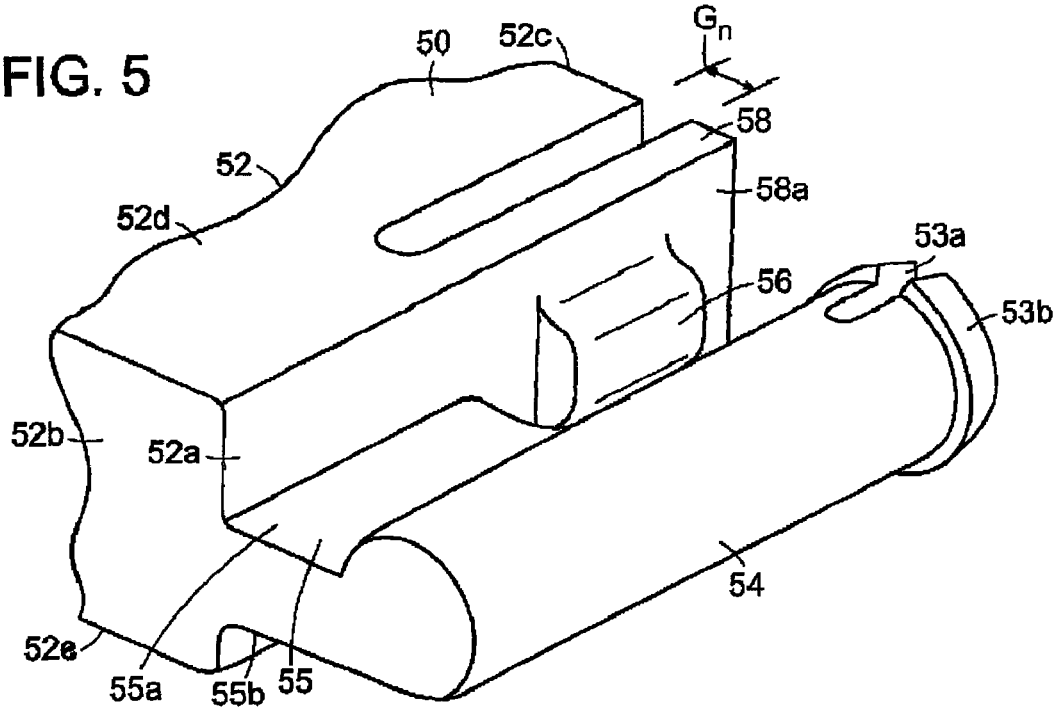
FIG. 5 is a schematic perspective view of a portion of an articulation mechanism with the socket-side element of FIG. 3 and the pin-side element of FIG. 4 in an open configuration.

FIG. 3 is schematic perspective view of a portion of first articulation member 32 pivotably or rotatably joined to second articulation member 34 around a hingeline. In this particular embodiment, first articulated member 32 may be a socket-side element 40 and second articulated member 34 may be a pin-side element 50. A person of ordinary skill in the art, given the benefit of this disclosure, would recognize that first articulated member 32 may be pin-side element 50 and second articulated member 34 may be socket-side element 40. FIGS. 4 and 5 are schematic perspective views of portions of the socket-side element 40 and pin-side element 50, respectively.

In FIG. 3, the hingeline between the first and second articulated members 32, 34 extends substantially perpendicular (from the lateral side of the article of footwear to the medial side) across the longitudinally axis of the article of footwear 100. In the more general case, the hingeline may extend from the lateral to the medial side at a non-perpendicular angle. Such an angled hingeline may increase the stiffness of the shoe in the longitudinal direction, as compared to a perpendicularly oriented hingeline.

Referring to FIG. 4, socket-side element 40 includes a body 42 having a front surface 42*a*, side surfaces 42*b*, 42*c*, and top and bottom surfaces, 42*d*, 42*e*, respectively. Socket-side element 40 further includes a socket 44 lying parallel to front surface 42*a* and extending from side surface 42*b* toward side surface 42*c*. At least a portion of socket 44 has a generally circular cross section. In this particular embodiment, socket 44 may be a through bore (extending all the way from side surface 42*b* to side surface 42*a*), although, in the more general case, socket 44 need not be a through bore.

Further, in this particular embodiment, a portion of socket 44 may be a slotted socket 44*a*, i.e., slotted socket 44*a* has a slot 45 extending along at least a portion of its longitudinal length. Slot 45 may be formed by slot sidewalls 45*a*, 45*b* extending from socket 44 to outer surfaces of body 42. In this particular embodiment, slot sidewall 45*a* extends from socket 44 to front surface 42*a* and slot sidewall 45*b* extends from socket 44 to bottom surface 42*e*. The longitudinal length of the slotted portion 44*a* of the socket 44 relative to the longitudinal length of the entire socket 44 is not critical. In one embodiment, socket 44 may have a slotted length of approximately 25% to approximately 75%, and in some examples from approximately 40% to approximately 60%, of the entire socket's length.

Again, referring to FIG. 4, socket-side element 40 includes a profiled surface 46. In this example embodiment, profiled surface 46 includes first concavity 46*a* and second concavity 46*b*. First concavity 46*a* may be provided on front surface 42*a*, while second concavity may be formed at the intersection of front surface 42*a* and bottom surface 42*e*. Additionally, profiled surface 46 includes a land portion 41 that may be defined between the two concavities 46*a*, 46*b*. Land portion 41 may lie substantially in the same plane as front surface 42*a*, or alternatively, land portion 41 may lie slightly above or below the plane of front surface 42*a*.

Referring to FIG. 5, pin-side element 50 includes a body 52 having a front surface 52*a*, side surfaces 52*b*, 52*c*, and top and bottom surfaces, 52*d*, 52*e*, respectively. Pin-side element 50 further includes a pin 54 lying parallel to front surface 52*a* and across, and beyond, the width of body 52. Pin 54 need not extend completely across the entire width of body 52. Pin 54 has a generally circular cross section. In this particular embodiment, one end of pin 54 includes a diametrically-oriented slot 53*a* and a circumferential collar 53*b*.

Pin 54 may be attached to front surface 52*a* via a neck 55. Neck 55 extends partially along the longitudinal length of pin 54. Neck 55 has an upper surface 55*a* and a lower surface 55*b*. In this particular embodiment, the width of neck 55 in the longitudinal direction of pin 54 may be approximately 50% of the length of pin 54 and approximately 50% of the width of body 52. As is apparent to a person of ordinary skill in the art, given the benefit of this disclosure, the width of neck 55 is not critical.

As best shown in FIG. 5, pin-side element 50 includes a protrusion 56 located on front surface 52*a*. In general, protrusion 56 will have rounded or chamfered upper and lower corners. Pin-side element 50 even further includes a biasing element 58. In this particular embodiment, biasing element 58 may be formed as a flexible cantilevered plate 58*a* that can flex transverse to front surface 52*a*. A gap is located between flexible cantilevered plate 58*a* and the remainder of body 52. When cantilevered plate 58*a* is not flexed, i.e., when cantilevered plate 58*a* is unstressed, the gap has a nominal dimension, $G_n$. Protrusion 56 may be located on biasing element 58. Thus, when biasing element 58 flexes, protrusion 56 moves away from or toward pin 54, and the gap in the vicinity of protrusion 56 increases or decreases. As protrusion 56 may be located on a cantilever plate in this particular embodiment, the dimension of the overall gap along the length of the cantilever is a function of position along the length of the cantilever when the cantilever flexes. In the discussion that follows regarding the changing dimension of the gap, the gap that is being referred to is the gap in the vicinity of the protrusion.

Referring back to FIG. 3, pin 54 of pin-side element 50 is shown inserted into socket 44 of socket-side element 40. When pin 54 is located within socket 44, neck 55 is located within slot 45. Protrusion 56 is shown extending into second concavity 46*b*.

Referring now to FIGS. 3 through 5, during insertion of pin 54 into socket 44, slot 53*a* allows the end of pin 54 to elastically deform such that collar 53*b* may fit within socket 44. When pin 54 is completely inserted within socket 44, collar 53*b* may extend beyond socket 44, such that the end of pin 54 may resume its undeformed shape. Alternatively, when pin 54 is completely inserted within socket 44, collar 53*b* may extend into a countersunk bore (not shown) at the end of socket 44, such that the end of pin 54 may resume its undeformed shape without extending beyond side wall 42*c*. Collar 53*b* forms a retention element, i.e., an element that assists in the retention of pin-side element 50 to socket-side element 40.

Thus, it can be seen that articulation assembly 30 includes a hinge assembly or hinge mechanism. In the example embodiment of FIGS. 3 through 5, the hinge mechanism includes pin 54 and socket 44. A person of ordinary skill in the art, given the benefit of this disclosure, would recognize that other hinge mechanisms would be suitable. For example, the hinge mechanism may be formed as a living hinge, i.e., as an elastomeric element unitarily formed with the first and second articulated members. Alternatively, other known hinge mechanisms utilizing flexure elements, bellows-type elements, sliding elements, etc. may be provided.

As will be described below, articulation assembly 30 further may include a cam mechanism. In the example embodiment of FIGS. 3 through 5, the cam mechanism includes cam (profiled) surface 46 and protrusion 56. As used herein, the term "cam" or the phrase "cam mechanism" refers to a cam member that communicates motion to a cam follower. A cam member typically includes a profiled cam surface relative to an axis of rotation. A cam follower typically slides or rides on the cam surface. As a non-limiting example, in one typical cam mechanism, the cam member may be a disk that rotates around an axis that is displaced from the center of the disk. A follower in contact with the cam surface slides on the cam surface as the disk turns and, at the same time, moves toward or away from the off-center axis around which the disk turns.

In certain example embodiments described herein, a protrusion associated with a first articulation member functions as a cam follower as it rides on a cam surface associated with a second articulation member, as the first and second articulation members rotate relative to one another.

In one aspect, the protrusion on the first articulation member may be biased or spring-loaded against the cam surface, such that it is free to translate relative to the rotational axis of the cam member, while the remainder of the first articulation member does not translate relative to the rotational axis of the cam member. In other words, in this particular aspect, only the biased protrusion (as opposed to the entire first articulation member) is displaced relative to the rotational axis of the cam member.

Figure 6:
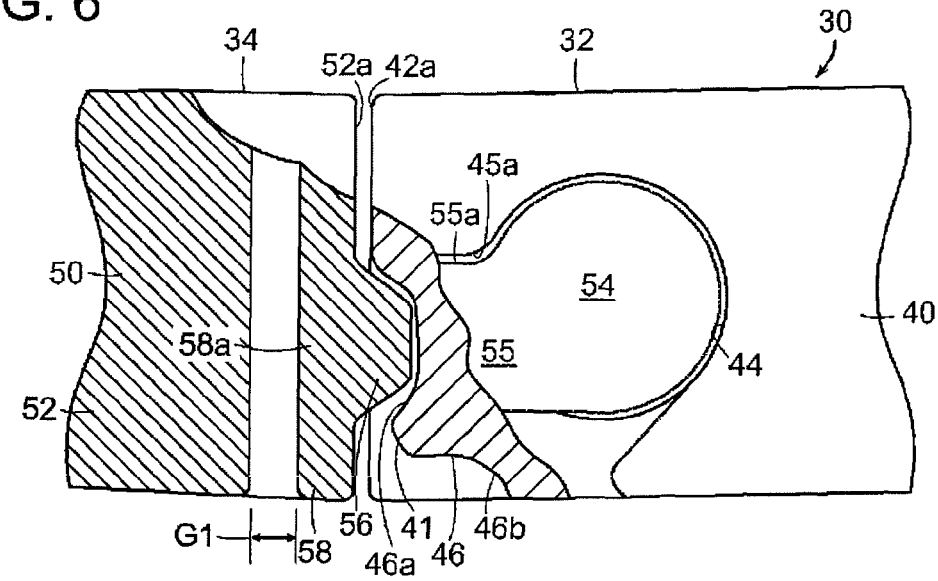
FIG. 6 is a schematic side view of an articulation mechanism in a closed configuration, with a cut-away showing details of the cam mechanism, according to an aspect of the present invention.
Figure 7:
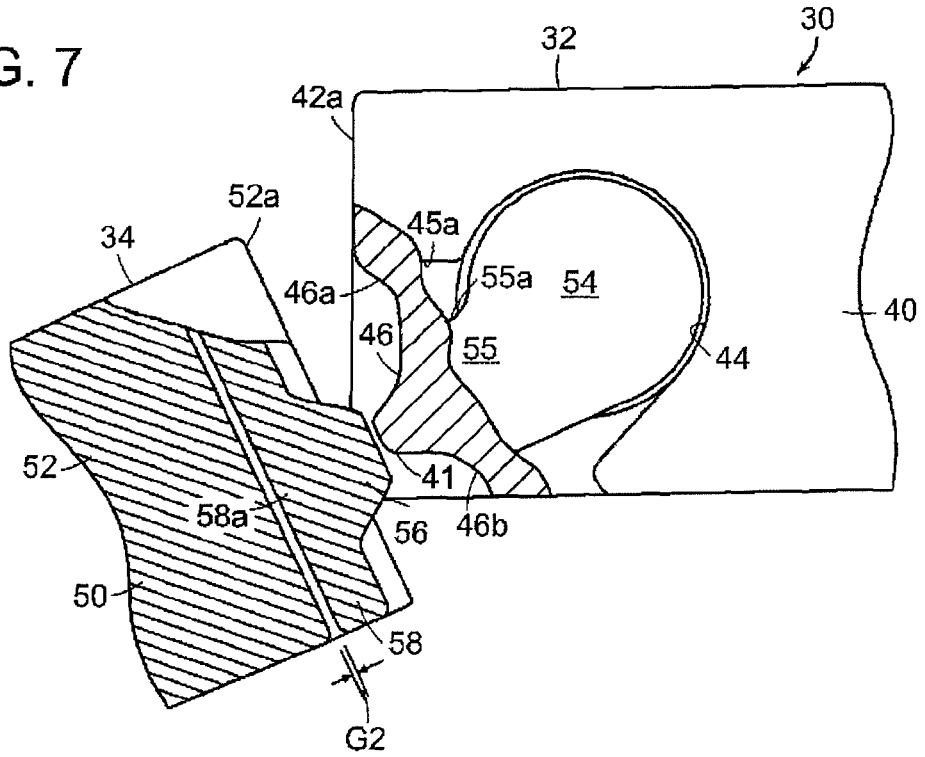
FIG. 7 is a schematic side view of the portion of the articulation mechanism of FIG. 6 in an intermediate configuration, with a cut-away showing details of the cam mechanism.
Figure 8:
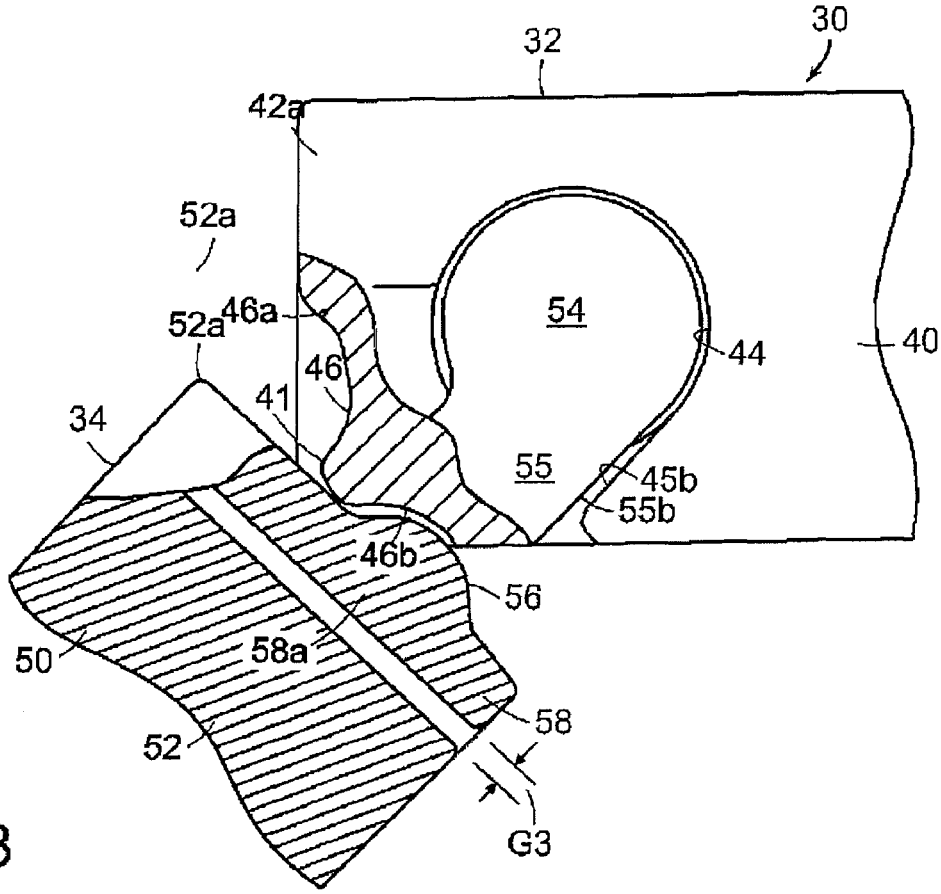
FIG. 8 is a schematic side view of the articulation mechanism of FIG. 6 in an open configuration, with a cut-away showing details of the cam mechanism.

FIGS. 6, 7 and 8 are schematic side views of a portion of an articulation mechanism according to an aspect of the invention. In these figures, portions of the articulation members are cut away to better show the details of a cam mechanism. FIG. 6 illustrates articulation assembly 30 in a closed configuration, with first articulated member 32 and second articulated member 34 substantially aligned with one another. FIG. 7 illustrates articulation assembly 30 in an intermediate configuration, when second articulated member 34 is rotated out of the plane of alignment with first articulated member 32. FIG. 8 illustrates articulation assembly 30 in an open configuration, when second articulated member 34 is rotated even further out of the plane of alignment with first articulated member 32. In these figures, as in FIGS. 3-5, first articulated member 32 is a socket-side element 40 and second articulated member 34 is a pin-side element 50, although these elements 40 and 50 may be provided on the other members 32 and 34, if desired.

Referring to FIG. 6, with articulation assembly 30 in the closed configuration, front surfaces 42*a* and 52*a* are adjacent to one another and substantially abutting or lying parallel to one another. Protrusion 56 extends into first concavity 46*a* of profiled cam surface 46. Upper surface 55*a* of neck 55 abuts, or at least substantially abuts, slot sidewall 45*a*, thereby limiting upward relative rotational movement of pin-side element 50 to socket-side element 40 beyond this closed configuration position. In this closed configuration, the dimension of the gap in the vicinity of protrusion 56 between biasing element 58 and the remainder of body 52 is G1. If biasing element 58 is unflexed, then G1 will be equal to the gap's nominal dimension $G_n$. Alternatively, if biasing element 58 is flexed, such that pin 54 is biased against socket 44, then G1 may be less than the nominal dimension, Gn. When biasing element 58 is flexed, pin 54 is biased against socket 44 and relative movement between pin-side element 50 and socket-side element 40 may be mitigated or even eliminated. In other words, in the closed configuration, biasing element 58 may operate to remove some or all of the slack (i.e. relative movement) in the articulation mechanism 30.

The extension of protrusion 56 into first concavity 46*a* provides a locking mechanism, in that protrusion 56 must be driven out of concavity 46*a* in order for movement of the cam mechanism to occur. The amount of energy or force required to overcome the locking feature may be influenced by various features of the mechanism construction, such as the relative geometries of protrusion 56 and cam surface 46, any flexing necessary to overcome biasing element 58, deformation of the protrusion 56 itself, the materials from which the various parts are constructed, etc. Further, by way of non-limiting examples, a locking mechanism may be provided by an interference fit, snap fit or other interlocking features between pin-side element 50 and socket-side element 40. By way of another non-limiting example, a locking mechanism may be provided by a frictional element or feature. A person of ordinary skill in the art, given the benefit of this disclosure, would recognize that any of these various mechanisms or combinations thereof may be used to provide a locking feature.

Referring to FIG. 7, with articulation assembly 30 in the intermediate configuration, pin-side element 50 has rotated downward with respect to socket-side element 40. In this intermediate configuration, front surfaces 42*a* and 52*a* are angled to one another and are no longer substantially abutting or lying parallel to one another. Further, upper surface 55*a* of neck 55 no longer abuts slot sidewall 45*a*. Protrusion 56 no longer extends into first concavity 46*a*, but instead has been positioned over land portion 41 of the profiled cam surface 46. In this intermediate configuration, the dimension of the gap in the vicinity of protrusion 56 between biasing element 58 and the remainder of body 52 is G2. As land portion 41 extends out further than concavity 46*a*, biasing element 58 must flex away from pin 54. This causes gap dimension G2 to be reduced. In other words, gap dimension G2 is less than gap dimension G1.

Disengaging the first and second locking elements from one another causes the heel portion to move out of the first articulated configuration and into a position that is between the first articulated configuration and the second articulated configuration, i.e., into the intermediate configuration. Between the first articulated configuration and the second articulated configuration, in the example as shown in FIG. 7 protrusion 56 may ride on land portion 41. Depending upon the geometry and materials of the structural components of the articulation assembly 30 of FIG. 7, protrusion 56 may slide easily over land portion 41 or it may require considerable force to move protrusion relative to land portion 41. In at least certain aspects, the force required to disengage the second locking element from the first locking element may be greater than the force required to move the second locking element over the span between the first articulated configuration and the second articulated configuration, i.e., over the span defining the intermediate configuration. In certain example embodiments, protrusion 56 may not even contact land portion 41 as heel portion 20 travels between the first and the second articulated configurations. In such instances, the force required to move between the first and second articulated configurations may be a function of friction between pin 54 and socket 44 or of other resistive forces in the system.

Now, referring to FIG. 8, with articulation assembly 30 in the open configuration, pin-side element 50 has rotated even further downward with respect to socket-side element 40. Now, protrusion 56 extends into second concavity 46*b* of profiled cam surface 46. Similar to the closed configuration, the extension of protrusion 56 into concavity 46*b* may provide a locking mechanism. Lower surface 55*b* of neck 55 abuts, or at least substantially abuts, slot sidewall 45*b*, thereby limiting any further downward rotation of pin-side element 50 relative to socket-side element 40. In this open configuration, the dimension of the gap in the vicinity of protrusion 56 between biasing element 58 and the remainder of body 52 is G3. If concavity 46*b* is deep enough, then biasing element 58 may be unflexed such that G3 is equal to the gap's nominal dimension $G_n$. Alternatively, if biasing element 58 is flexed, such that pin 54 is biased against socket 44, then G3 will be less than the nominal dimension, $G_n$, and relative movement between pin-side element 50 and socket-side element 40 may be mitigated or even eliminated.

As shown in FIGS. 6 through 8, articulation assembly 30 may swing through an angle of up to approximately 45 degrees when moving from the closed configuration to the open configuration. As would be apparent to a person of ordinary skill in the art, given the benefit of this disclosure, articulation mechanism may also swing through a smaller or greater angular range when moving from the closed configuration to the open configuration. Various design factors, such as the stiffness of the upper, the size of the upper's opening, the height of the heel's counter, etc. may influence the desired angle of rotation of the articulation mechanism. Thus, for example, it may be desirable to have articulation assembly 30 rotate through a relatively small angle of approximately 10 or approximately 15 degrees if the upper is very flexible or if the heel counter is low. Alternatively, it may be desirable to have articulation assembly 30 rotate through a relative large angle of approximately 80 or approximately 90 degrees if the heel counter is very high (as would be found in a boot or a high top athletic shoe). Thus, in one embodiment, the angle through which articulation assembly 30 sweeps from the open configuration to the closed configuration may be up to approximately 90 degrees. In another embodiment, the angle through which articulation assembly 30 sweeps may be up to approximately 70 degrees. In other embodiments, the angle through which articulation assembly 30 sweeps may be up to approximately 50 degrees, or more narrowly up to approximately 30 degrees, or even more narrowly, only up to approximately 20 degrees. Further, as would be apparent to a person of ordinary skill in the art, given the benefit of this disclosure, more than two concavities may be included in the articulation mechanism, such that intermediate, positive-locking configurations may be provided. Even further, as would be apparent to a person of ordinary skill in the art, given the benefit of this disclosure, protrusion 58 may be located on either pin-side element 50 or socket-side element 40 and concavities 46 may be located on the other of the pin-side or socket-side element.

Figure 9:
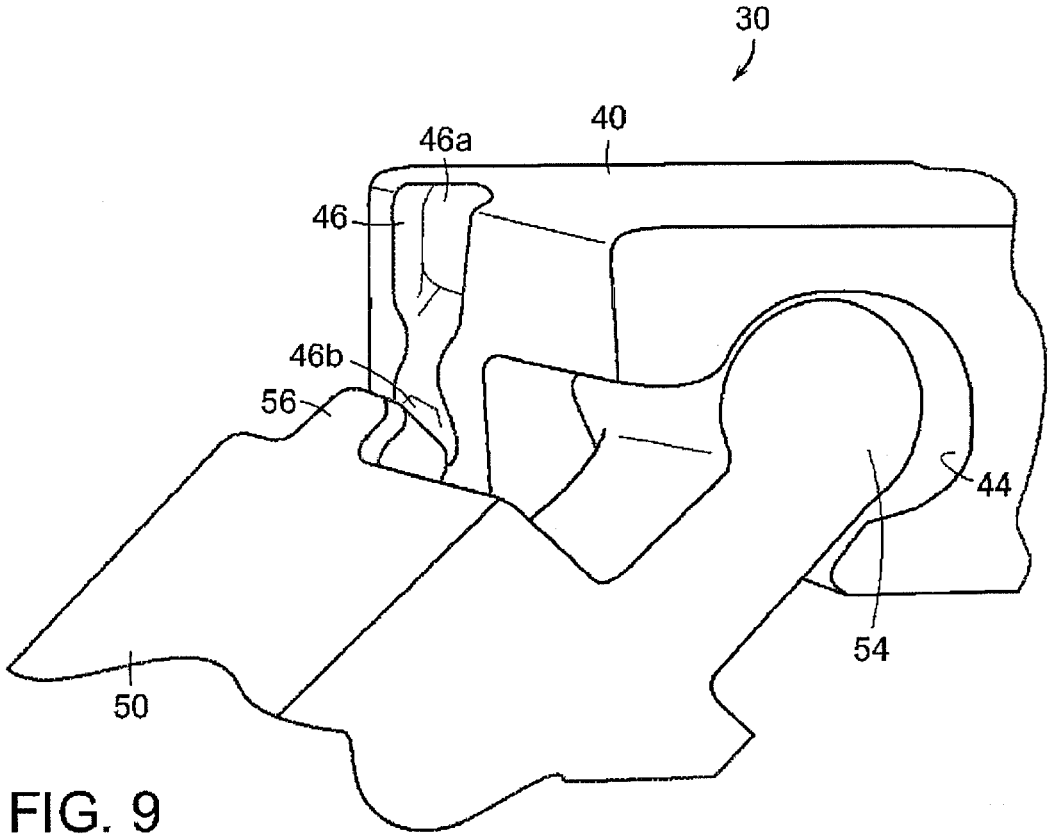
FIG. 9 is a schematic perspective view of a portion of an articulation mechanism, in an open configuration, according to an aspect of the present invention.
Figure 10:
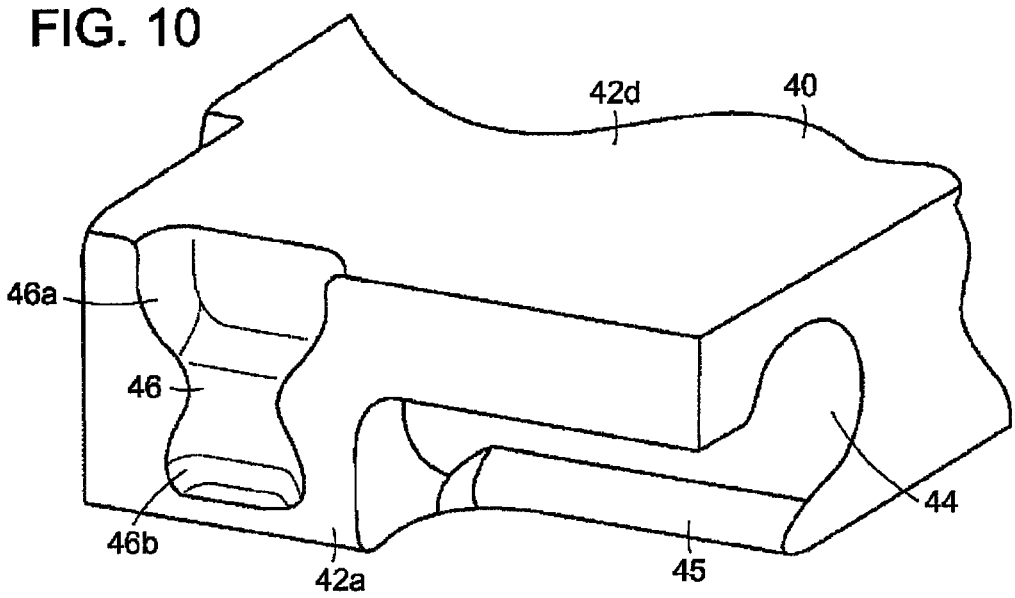
FIG. 10 is a schematic perspective view of a portion of a socket-side element of the articulation mechanism of FIG. 9.
Figure 11:
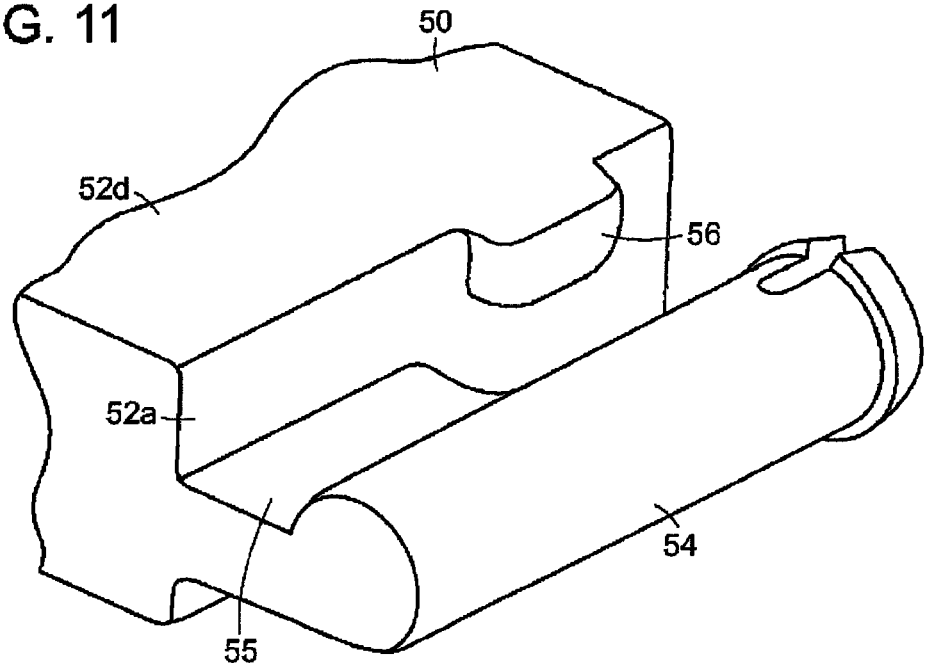
FIG. 11 is a schematic perspective view of a portion of a pin-side element of the articulation mechanism of FIG. 9.
Figure 12:
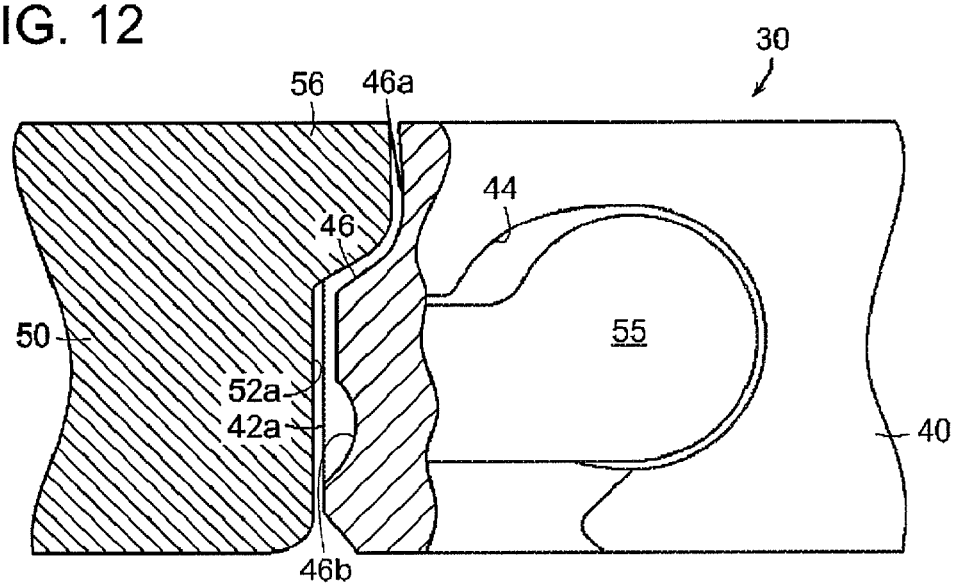
FIG. 12 is a schematic side view of a portion of the articulation mechanism of FIG. 9 in a closed configuration, with a partial cut-away showing details of the cam mechanism.
Figure 13:
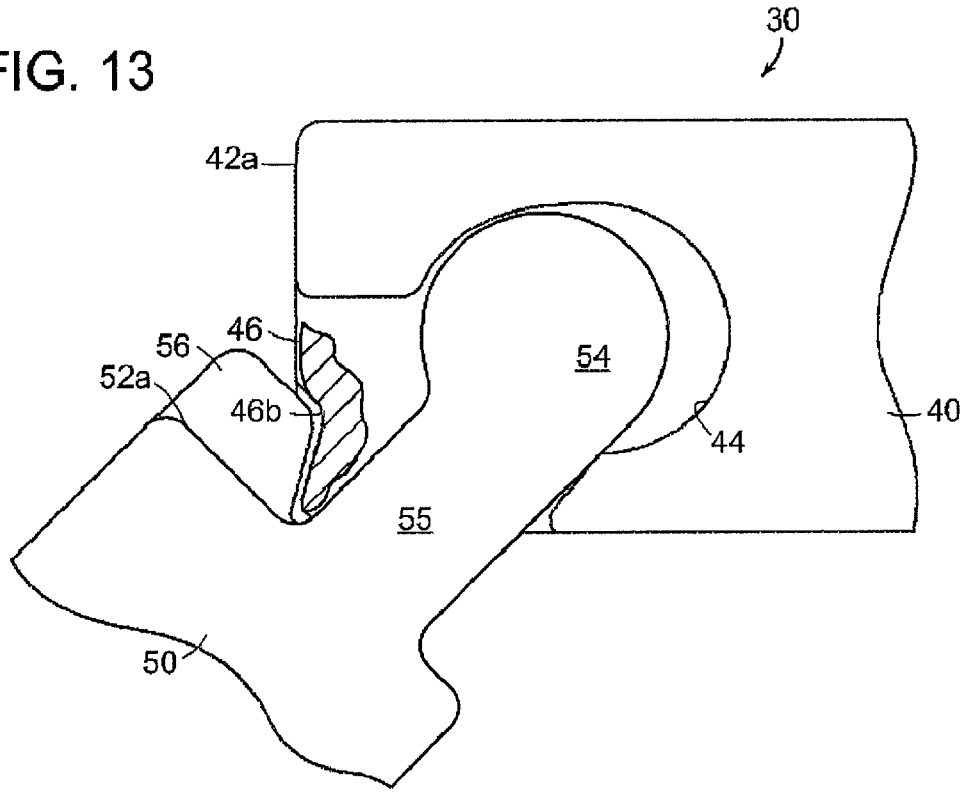
FIG. 13 is a schematic side view of the articulation mechanism of FIG. 9 in an open configuration, with a partial cut-away showing a detail of the cam mechanism.

FIGS. 9 through 13 schematically illustrate another aspect of the present invention. FIG. 9 is schematic perspective view of a portion of pin-side element 50 pivotably joined to socket-side element 40 according to this other aspect. FIGS. 10 and 11 are schematic perspective views of portions of the socket-side element 40 and pin-side element 50, respectively. FIGS. 12 and 13 show details of the cam mechanism. In the following description of the aspect of the invention of FIGS. 9 through 13, features that are in common with the aspect of the invention shown in FIGS. 1 through 8 are, for the most part, not discussed. Rather, the following description focuses on those features that differ from the aspects of the invention described in FIGS. 1 through 8.

According to this aspect of the present invention, the protrusion is not free to displace relative to the remainder of the associated first articulation member. Thus, when the protrusion translates relative to the rotational axis of the cam member (the second articulation member), the entire first articulation member may be translationally displaced relative to the rotational axis of the cam member. In one embodiment, as discussed below, the pin associated with the first articulation member moves transversely within the socket associated with the second articulation member as the protrusion follows the cam surface. To accommodate this transverse movement, the socket may be transversely elongated.

Referring to FIG. 9, pin-side element 50 is shown rotatably coupled to socket-side element 40. Specifically, pin 54, having a circular cross-section, has been inserted into socket 44, having an elongated, non-circular cross-section. Protrusion 56 is shown extending into second concavity 46*b* of the profiled cam surface 46.

Referring to FIG. 10, similar to the embodiment shown in FIG. 3, socket-side element 40 includes a socket 44 lying parallel to front surface 42*a*. However, in this embodiment, socket 44 has an elongated, non-circular cross section.

Further, although similar to the embodiment shown in FIG. 3, in that socket-side element 40 includes first concavity 46*a* and second concavity 46*b*, in this particular embodiment the placement of the concavities in FIG. 10 differs from that of the embodiment of FIG. 3. Specifically, in FIG. 10, first concavity 46*a* of the profiled cam surface 46 may be formed in front surface 42*a* at the intersection of front surface 42*a* with top surface 42*d*. Second concavity 46*b* may be formed in front surface 42*a*, below first concavity 46*a*. A raised land area may be provided between the concavities 46*a* and 46*b*.

Referring to FIG. 11, pin-side element 50 includes pin 54 lying parallel to front surface 52*a*. Pin 54 has a generally circular cross section, as in the embodiment of FIG. 4. However, as best shown in FIG. 11, pin-side element 50 includes a protrusion 56 located on front surface 52*a* and forming an in-plane extension of top surface 52*d*. In contrast to the embodiment of FIG. 4, in the embodiment of FIG. 11, pin-side element 50 does not include a biasing element.

FIG. 12 is a side view of a portion of the articulation assembly 30 of FIG. 9 in a closed configuration according to this aspect of the present invention, and FIG. 13 shows the same articulation assembly 30 in an open configuration. Referring to FIG. 12, with front surfaces 42*a*, 52*a* substantially facing one another in the first configuration, protrusion 56 extends into first concavity 46*a*. Pin 54 extends longitudinally within socket 44. In this embodiment, socket 44 has an elongated, non-circular cross-section that allows pin 54 to slide transversely (i.e. perpendicular to the pin's longitudinal axis) back-and-forth within the socket 44.

Referring to FIG. 13, in the second configuration, pin-side element 50 has been rotated downward with respect to socket-side element 40, and in the process, protrusion 56 has moved out of first concavity 46*a* and into second concavity 46*b*. Second concavity 46*a* may be shallower than first concavity. As a result, when pin-side element 50 rotates downward with respect to socket-side element 40, pin-side element 50 may be forced to move transversely to the left. This causes pin 54 to move transversely to the left within socket 44. Specifically, pin 54 slides toward the front surface 42*a* of socket-side element 40 and bears against the front-most surface of socket 44. In this open configuration, in this particular embodiment, there may be little or no relative motion between pin-side element 50 and socket-side element 40.

Figure 14:
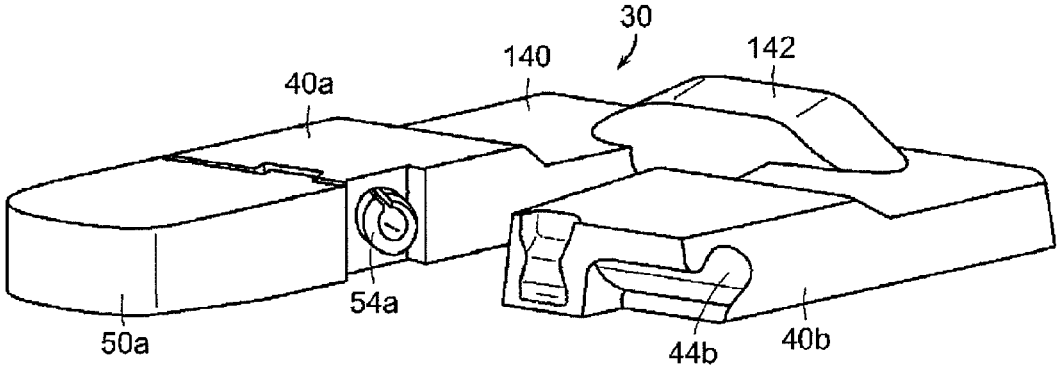
FIG. 14 is a schematic perspective view of an articulation mechanism, in a closed configuration and with a pin-side element removed for clarity, according to an aspect of the present invention.

FIG. 14 illustrates an articulation mechanism 30, in a closed configuration and with a pin-side element removed for clarity, according to an aspect of the present invention. Specifically, a socket-side element assembly 140 is provided. Assembly 140 includes a first socket-side element 40*a* and a second socket-side element 40*b*. In this particular embodiment, first socket-side element 40*a* and second socket-side element 40*b* are mirror images of one another: first socket-side element 40*a* may be a left-handed element in that pin 56 would be inserted into socket 46 from the left-hand side and second socket-side element 40*b* may be a right-handed element in that pin 56 would be inserted into socket 46 from the right-hand side. Further, assembly 140 includes a bridge element 142 that connects first socket-side element 40*a* to second socket-side element 40*b*. In certain embodiments, assembly 140 may be formed (for example, molded) as a single element.

In this embodiment, articulation mechanism 30 includes first and second pin-side elements. Pin-side element 50*a* is shown rotatably attached to first socket-side element 40*a*. For purposes of illustrating the right-hand side socket-side joint, the right-handed pin-side element has been omitted from the figure. The first and second pin-side elements may be separate from one another. For example, this may be desirable for ease of assembly when the pin-side elements are inserted into the socket-side elements from opposite sides. Alternatively, the first and second pin-side elements may be formed as a single element. This may enhance the stability of the articulation mechanism. As even another alternative, the first and second pin-side elements may be formed as two separate elements and then subsequently joined together after assembly with the socket-side elements.

Figure 15:
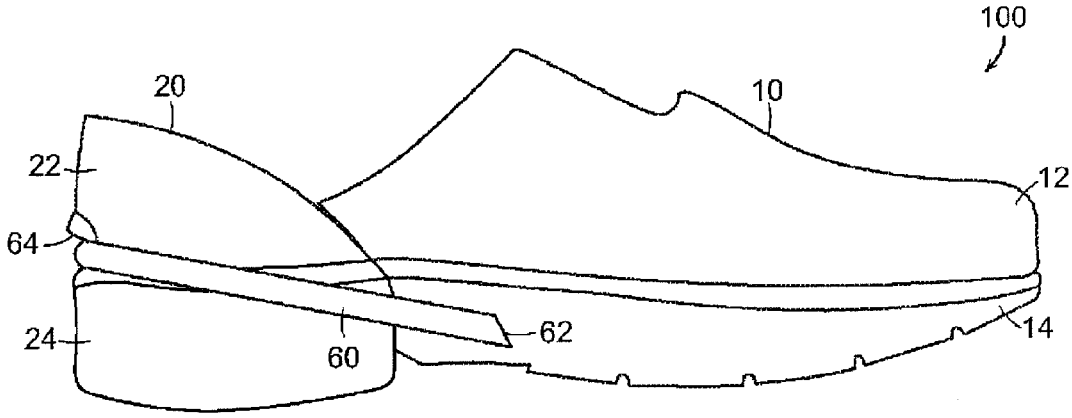
FIG. 15 is a side elevation view of an article of footwear in a closed configuration according to a further aspect of the present invention.
Figure 16:
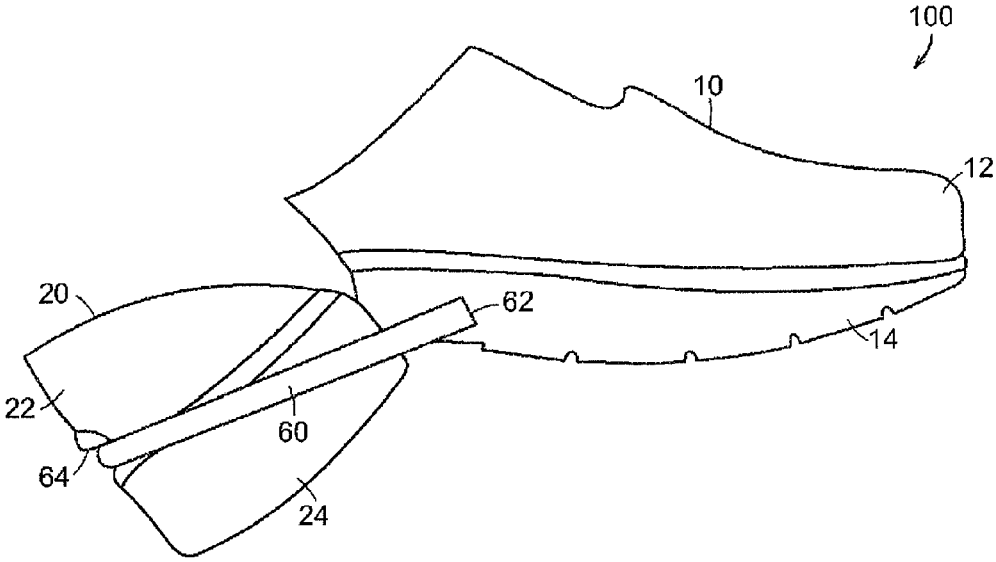
FIG. 16 is a side elevation view of the article of footwear of FIG. 15 in an open configuration.

FIG. 15 is a side elevation view of an article of footwear in a closed configuration according to a further aspect of the present invention. FIG. 16 is a side elevation view of the article of footwear of FIG. 15 in an open configuration. Article of footwear 100 includes a forefoot portion 10 having a forefoot upper 12 and a forefoot sole 14. Article of footwear 100 further includes a heel portion 20 having a heel upper 22 and a heel sole 24. Heel portion 20 is rotatably coupled to forefoot portion 10.

In the embodiment of FIG. 15, an anchoring element 60 extends from forefoot portion 10 to heel portion 20. Specifically, anchoring element 60 extends from forefoot sole 14 to heel upper 22. In the closed configuration, anchoring element 60 serves to snug heel portion 20 against forefoot portion 10; in the open configuration, anchoring element 60 serves to stabilize heel portion 20 relative to forefoot portion 10. A person of ordinary skill in the art, given the benefit of this disclosure, would recognize that anchoring element 60 may be used in conjunction with any of the articulation assemblies described and claimed herein.

Anchoring element 60 may be attached to forefoot sole 14 at a forefoot end 62 on the right side of the article of footwear and may extend to heel upper 22. Anchoring element 60 may be securely attached to heel upper 22. A second anchoring element 60 may be provided on the left side of the article of footwear. Alternatively, anchoring element 60 may be a single element that extends from forefoot sole 14 on the right side of footwear 100 to forefoot sole 14 on the left side of the article of footwear 100. In such case, anchoring element 60 may wrap around heel upper 22. Further, anchoring element 60 may be restrained from sliding or shifting on heel upper 22. For example, anchoring element 60 may be placed in a channel or notch-like feature 64 associated with heel upper 22. Alternatively or additionally, anchoring element 60 may be placed in a channel (not shown) associated with heel upper 22 and/or heel sole 24. This channel or recessed groove may accommodate a substantial portion of anchoring element 60, to thereby prevent anchoring element 60 from snagging or catching on other objects.

Anchoring element 60 may be formed of a flexible material or it may be formed of relatively inextensible materials wherein a degree of flexibility may be derived from its manufacture. By way of non-limiting examples, anchoring element 60 may be formed of a strip of leather or plastic. By way of other non-limiting examples, anchoring element 60 may be formed of strands of metal that are then braided or corded to form a relatively flexible element. As even another non-limiting example, anchoring element 60 may be formed as a chain of relatively inextensible links.

Alternatively, anchoring element 60 may be formed as a relatively inflexible and inextensible element. In such an embodiment, a degree of flexibility may be provided by the attachment of anchoring element 60 to heel portion 20 or forefoot portion 10. For example, the attachments of anchoring element 60 to the article of footwear may include rotational and/or translational degrees of freedom. Alternatively, a degree of flexibility may be provided by an inherent flexibility in the heel portion 20 or forefoot portion 10, themselves. Thus, for example, heel upper 22 or forefoot sole 14 may inherently flexibly accommodate any change in distance between the attachment points of anchoring element 60 that are experienced as heel portion 20 rotates relative to forefoot portion 10.

The forefoot articulation member and/or the heel articulation member may be a molded polymer element. A molded polymer material provides a lightweight, flexible element that may be relatively inexpensive and easy to produce. By way of non-limiting examples, suitable polymeric materials include injectable plastics, urethanes, such as thermoplastic polyurethane (TPU), nylons, and polyether block amides, such as Pebaxg. Other polymeric and non-polymeric materials, including as non-limiting examples, metals or fiber composites, and combinations thereof, may be used to form the articulation members.

Further, each of the articulation members may be formed as a unitary member or may be formed by assembling one or more items. For example, the pin may be formed separately and then, for example, co-molded with the remainder of the pin-side articulation element. In such an instance, the pin may be fixedly or non-rotatably attached to the pin-side element. Alternatively, the pin may be rotatably attached to the pin-side element.

According to another aspect of the present invention, a sole assembly including a forefoot sole portion, a heel sole portion, and an articulation assembly is provided. The individual articulation members may be molded separately (partially or fully cured) and then co-molded with the desired sole components. Alternatively, adhesive may be used to assembly the articulation members to the sole portions. By way of further non-limiting examples, mechanical fasteners, snap fits, interference fits, or other physical mechanisms may be used to attach the articulation members to the sole portions.

Figure 17:
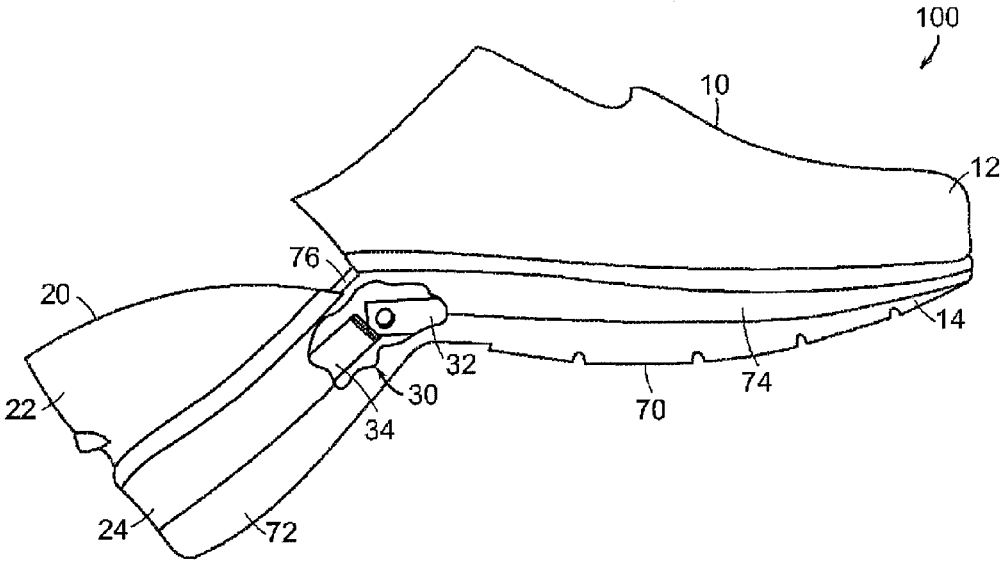
FIG. 17 is a side elevation view of the article of footwear in an open configuration according to even a further aspect of the present invention.

In one aspect, as best shown in FIG. 17, forefoot sole portion 14 and heel sole portion 24 may be formed as a continuous sole 70. Thus, in one embodiment, some or all of an outsole 72, a midsole 74, and an insole 76 may extend over the articulated region of articulation assembly 30. Sole structure 70 in the articulated region flexibly accommodates the strains experienced as heel portion 20 articulates relative to sole portion 10. The material of the sole structure 70 and/or other structural features, such as, for example, an accordion-type or bellows-type element, may be used to provide sufficient flexibility in the articulated region. In another aspect, the articulation members themselves may form at least some of the sole portions.

In one aspect, sole structure 70 may include an outsole 72 that extends continuously from the heel portion 20 to the forefoot portion 10. According to one embodiment, outsole 72 may be a ground-contacting member. In any event, outsole 72 may extend beneath articulation assembly 30 such that it provides a solid barrier between the ground and the articulation assembly. Dirt or other debris may thus be prevented or inhibited from entering into the articulation assembly and potentially degrading the performance of the articulation assembly. In a further aspect, sole structure 70 may enclose or encase articulation assembly 30. Midsole 74 may extend over the top surface of articulation assembly 30, outsole 72 may extend over the lower surface of articulation assembly 30, and one of midsole 74 or outsole 72 (or even a separate sole element) may extend over the side surfaces of articulation assembly 30, thereby completely enclosing or encapsulating articulation assembly 30. This may provide even further protection of articulation assembly 30 from the elements. Optionally, articulation assembly 30 may be encased, or partially encased, by a separate encasement element in order to inhibit dirt or debris from getting between the parts of the assembly.

In another aspect, the articulation assembly 30 does not extend beyond the upper and lower boundaries of the sole portions 14, 24. Articulation assembly 30 may be entirely located between the upper surface of the sole structure and the ground-contacting surface of the sole structure. This compact arrangement may eliminate or mitigate breakage and/or potential safety issues due to hardware items associated with the articulation assembly extending beyond the surfaces of the sole structure and catching on objects on the ground.

According to even another aspect of the invention, a method of donning an article of footwear as described above is provided. The method may include readying the article of footwear for insertion of a user's foot by downwardly articulating a heel portion relative to a forefoot portion to an "open" position (see, for example, FIG. 2) so as to provide a larger opening in the article of footwear. The user's forefoot may then be placed or inserted within the forefoot portion. The heel portion may then be upwardly articulated relative to the forefoot portion back to its original or "closed" position (see, for example, FIG. 1).

The step of articulating includes rotating the heel portion relative to the forefoot portion around a hinge element. FIGS. 6-8, for example, show pin-side element 50 (which may be mounted to heel portion 22) rotating relative to socket-side element 40 (with may be mounted to forefoot portion 12) around pin 54 which rotates within socket 44. In this embodiment, pin 54 and socket 44 are hinge elements that provide a hinge assembly. Alternatively, the step of articulating may also include sliding a protrusion on a cam surface. This may best be seen by referring to FIG. 7, wherein protrusion 56 is shown sliding on cam surface 46.

The method may further include aligning a sole of the heel portion with a sole of the forefoot portion and locking the heel portion to the forefoot portion. Locking involves providing a resistance to moving the heel portion relative to the forefoot portion when the portions, in this example, are aligned and in a first configuration. Thus, unlocking the heel portion from the forefoot portion involves overcoming the locking resistance. As shown in FIG. 6, a locking resistance may be provided by locating a protrusion 56 in a first concavity 46*a* or depression. Concavity 46*a* is shown as being provided in cam surface 46.

The method may also include biasing the heel portion relative to the forefoot portion during the step of articulating. Biasing may provide a stiffness between the heel portion and the forefoot portion in order to mitigate or eliminate undesired play or movement between the two portions. Referring to FIG. 3 as an example embodiment, biasing element 58 biases protrusion 56 against cam surface 46 over at least a portion of the path that protrusion 56 travels as pin-side element 50 rotates relative to socket-side element. Biasing elements may be used to account for manufacturing tolerances and/or to provide a stiffer feel to the articulated assembly.

The method may even further include translating the heel portion relative to the forefoot portion during the step of articulating. This relative translation may accommodate movement involved in a locking or unlocking feature. For example, referring to FIG. 12, unlocking protrusion 56 from concavity 46*a* may involve sliding pin 54 within a laterally-elongated socket 44 in a sideways or lateral direction (i.e., perpendicular to the longitudinal axis of the pin). Sliding pin 54 within laterally-elongated socket 44 causes heel portion to translate relative to the forefoot portion.

To remove the article of footwear from a user's foot, the heel portion may be once again downwardly rotated relative to the forefoot portion to an "open" position and the user's forefoot may then be removed from within the forefoot portion.

An individual skilled in the relevant art will appreciate that the concepts disclosed herein apply to a wide variety of footwear styles, in addition to the specific style discussed above and depicted in the accompanying figures. For example, the sole structures and articulation assemblies described herein may be applied to a wide range of athletic footwear styles, including tennis shoes, football shoes or other cleats, cross-training shoes, walking shoes, running shoes, soccer shoes, and hiking boots, for example. The sole structure may also be applied to footwear styles that are generally considered to be non-athletic, including dress shoes, loafers, sandals, and work boots.

Further, an individual skilled in the relevant art will appreciate that other features and variations of the concepts disclosed herein may be apply to various articles of footwear without departing from the spirit and scope of the invention. For example, the above-described articulation assemblies and anchoring elements may be used in combination with conventional securing elements, such as laces, buckles, hook-and-loop straps, elastic gores, etc. As other examples, additional elements, such as cushioning or bootie members, arch supports, ankle supports, heel cushioning members, etc., may be included with the article of footwear. As another example, one or more elements that extend over the hingeline to provide specific, localized stiffness or cushioning in the articulation region may be provided. The articulation assembly need not be centered relative to the thickness of the sole structure. Thus for example, if the heel sole structure is thicker than the forefoot sole structure, the articulation assembly may be centered within the forefoot sole structure, but be positioned more toward the top of the heel sole structure. Even further, more than one articulation assembly may be included in any given article of footwear.

While there have been shown, described, and pointed out fumdamental novel features of various aspects, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described aspect to another are also fully intended and contemplated. It is the intention, therefore, to be limited only as indicated by the scope of the claims appended hereto. Further, all examples, whether demarcated by the terms "for example," "such as," "including," "etc." or other itemizing terms, are meant to be non-limiting examples, unless otherwise stated or obvious from the context of the specification.

What is claimed:

1. An article of footwear comprising:

a forefoot portion;

a heel portion movable relative to the forefoot portion from a first articulated configuration to a second articulated configuration; and an articulation assembly having a forefoot articulation member and a heel articulation member, the articulation assembly coupling the forefoot portion to the heel portion and including:

a hinge mechanism configured to rotate the heel portion relative to the forefoot portion around an axis of rotation; and a cam mechanism including a cam surface and a cam follower, the cam surface configured to move the cam follower toward or away from the axis of rotation.

2. The article of footwear of claim 1, wherein the hinge mechanism includes a socket provided by one of the forefoot articulation member and the heel articulation member and a pin provided by the other of the forefoot articulation member and the heel articulation member; and wherein the pin is rotatably located in the socket.

3. The article of footwear of claim 1, wherein the hinge mechanism includes a socket provided by one of the forefoot articulation member and the heel articulation member and a pin provided by the other of the forefoot articulation member and the heel articulation member; and wherein the pin is located in the socket and is transversely movable within the socket.

4. The article of footwear of claim 1, wherein the cam surface is provided by one of the forefoot articulation member and the heel articulation member; and the cam follower is a protrusion provided by the other of the forefoot articulation member and the heel articulation member;

wherein the protrusion is configured to ride on the cam surface when the heel portion moves between the first and the second articulated configurations.

5. The article of footwear of claim 4, wherein the cam surface includes a first concavity configured to receive the protrusion when the heel portion is in the first articulated configuration.

6. The article of footwear of claim 5, wherein the cam surface includes a second concavity configured to receive the protrusion when the heel portion is in the second articulated configuration.

7. The article of footwear of claim 1, wherein the articulation assembly further includes a biasing element configured to translationally bias the heel portion relative to the forefoot portion.

8. The article of footwear of claim 7, wherein the cam mechanism includes the cam surface provided by one of the forefoot articulation member and the heel articulation member; and wherein the biasing element is configured to ride on the cam surface.

9. The article of footwear of claim 7, further comprising a sole structure having an upper surface and a ground-contacting surface; and wherein the articulation assembly is entirely located between the upper surface of the sole structure and the ground-contacting surface of the sole structure.

10. The article of footwear of claim 1, wherein at least one of the forefoot articulation member and the heel articulation member is a molded polymer member.

11. The article of footwear of claim 1, wherein the heel articulation member is rotatably and translationally coupled to the forefoot articulation member.

12. The article of footwear of claim 11, wherein the hinge mechanism includes a socket having a non-circular cross-section.

13. The article of footwear of claim 11, further comprising a sole structure having an upper surface and a ground-contacting surface; and wherein the articulation assembly is entirely located between the upper surface of the sole structure and the ground-contacting surface of the sole structure.

14. The article of footwear of claim 1, further comprising:

an anchoring element configured to extend from the heel portion to the forefoot portion.

15. The article of footwear of claim 14, wherein the anchoring element is a biasing element.

16. The article of footwear of claim 1, wherein the forefoot portion includes a forefoot upper and a forefoot sole;

wherein the heel portion includes a heel upper and a heel sole; and further comprising an anchoring element extending from the forefoot sole to the heel upper.

17. The article of footwear of claim 16, wherein the anchoring element is secured to the forefoot sole.

18. The article of footwear of claim 1, further comprising:

a locking mechanism including:

a first locking element provided on a surface; and a second locking element configured to engage the first locking element when the heel portion is in the first articulated configuration;

wherein the force required to disengage the second locking element from the first locking element is greater than the force required to move heel portion between the first articulated configuration and the second articulated configuration.

19. The article of footwear of claim 18, wherein the second locking element is configured to ride on the surface during movement of the heel portion between the first and the second articulated configurations.

20. The article of footwear of claim 18, wherein first locking element is a first concavity; and wherein the second locking element is a protrusion configured to extend into the first concavity in the first articulated configuration.

21. The article of footwear of claim 1, further comprising a sole structure having an outsole extending from the heel portion to the forefoot portion, wherein the outsole extends over the articulation assembly and provides a barrier between the ground and the articulation assembly.

22. The article of footwear of claim 1, further comprising a sole structure extending from the heel portion to the forefoot portion, wherein the sole structure encloses the articulation assembly.

23. An article of footwear comprising:

a forefoot portion;

a heel portion movable relative to the forefoot portion from a first articulated configuration to a second articulated configuration;

a sole structure extending from the heel portion to the forefoot portion, the sole structure having an upper surface and a lower surface; and a hinge mechanism joining the forefoot portion to the heel portion, wherein the upper and lower surfaces of the sole structure extend over the hinge mechanism and join the forefoot portion to the heel portion.

24. The article of footwear of claim 23, further comprising a locking mechanism having a first locking element provided on a surface of one of the heel portion and the forefoot portion and a second locking element provided on the other of the heel portion and the forefoot portion, the second locking element configured to engage the first locking element when the heel portion is in the first articulated configuration.

25. The article of footwear of claim 24, wherein the second locking element is configured to ride on the surface during movement of the heel portion between the first and the second articulated configurations.

26. The article of footwear of claim 24, wherein first locking element is a first concavity; and wherein the second locking element is a protrusion configured to extend into the first concavity in the first articulated configuration.

27. The article of footwear of claim 26, wherein the locking mechanism includes a second concavity and wherein the protrusion is configured to extend into the second concavity in the second articulated configuration.

28. The article of footwear of claim 23, wherein the hinge mechanism includes a socket and a pin rotatably located in the socket; and further comprising a biasing element configured to transversely bias the pin in the socket.

29. The article of footwear of claim 28, wherein the socket has a non-circular cross-section.

30. The article of footwear of claim 23, wherein the forefoot portion includes a forefoot upper and a forefoot sole;

wherein the heel portion includes a heel upper and a heel sole; and further comprising an anchoring element extending from the forefoot sole to the heel upper.

31. The article of footwear of claim 30, wherein the anchoring element is secured to the forefoot sole.

32. An articulation assembly for an article of footwear, the articulation assembly comprising:

a forefoot articulation member;

a heel articulation member, the heel articulation member being movable relative to the forefoot articulation member from a first articulated configuration to a second articulated configuration;

a hinge mechanism configured to rotate the heel portion relative to the forefoot portion around an axis of rotation; and a cam mechanism including a cam surface and a cam follower, the cam surface configured to move the cam follower toward or away from the axis of rotation.

33. The articulation assembly of claim 32, wherein the hinge mechanism includes a socket provided by one of the forefoot articulation member and the heel articulation member and a pin provided by the other of the forefoot articulation member and the heel articulation member, the pin rotatably located in the socket; and wherein the cam surface is provided by one of the forefoot articulation member and the heel articulation member and the cam follower is a protrusion provided by the other of the forefoot articulation member and the heel articulation member, the protrusion configured to ride on the cam surface when the heel portion moves between the first and the second articulated configurations.

34. The articulation assembly of claim 33, wherein the protrusion is configured to ride on the cam surface during movement of the heel articulation member between the first and the second articulated configurations.

35. The articulation assembly of claim 33, further comprising a biasing element configured to transversely bias the pin relative to the socket.

36. The articulation assembly of claim 33, wherein the cross-section of the socket is non-circular.

37. The articulation assembly of claim 32, wherein at least one of the forefoot articulation member and the heel articulation member is a molded polymer element.

38. The articulation assembly of claim 32, further comprising:

a locking mechanism including:

a first locking element provided on a surface; and a second locking element configured to engage the first locking element when the heel portion is in the first articulated configuration;

wherein the force required to disengage the second locking element from the first locking element is greater than the force required to move the second locking element between the first articulated configuration and the second articulated configuration.

39. The article of footwear of claim 38, wherein the second locking element is configured to ride on the surface during movement of the heel portion between the first and the second articulated configurations.

40. The article of footwear of claim 38, wherein first locking element is a first concavity; and wherein the second locking element is a protrusion configured to extend into the first concavity in the first articulated configuration.

41. The article of footwear of claim 40, wherein the locking mechanism includes a second concavity and wherein the protrusion is configured to extend into the second concavity in the second articulated configuration.

42. A sole structure for an article of footwear, comprising a forefoot sole portion;

a heel sole portion; and an articulation assembly including:

a forefoot articulation member coupled to the forefoot sole portion;

a heel articulation member coupled to the heel sole portion;

a hinge mechanism configured to rotate the heel portion relative to the forefoot portion around an axis of rotation; and a cam mechanism including a cam surface and a cam follower, the cam surface configured to move the cam follower toward or away from the axis of rotation.

43. The sole structure of claim 42, wherein the forefoot sole portion and the heel sole portion form a continuous sole portion having at least one of a continuous ground-contacting sole element and a continuous midsole element.

44. The sole structure of claim 43, wherein the articulation assembly does not extend beyond the boundaries of the continuous sole portion.

45. The sole structure of claim 43, wherein the articulation assembly is enclosed within the continuous sole portion.

46. The sole structure of claim 42, wherein the cam surface is provided by one of the forefoot articulation member and the heel articulation member; and the cam follower is a protrusion provided by the other of the forefoot articulation member and the heel articulation member;

wherein the protrusion is configured to ride on the cam surface when the heel sole portion moves between a first articulated configuration and a second articulated configuration.

47. The sole structure of claim 42, wherein the articulation assembly further includes a locking mechanism including:

a first locking element provided on a surface; and a second locking element configured to engage the first locking element when the heel sole portion is in the first articulated configuration;

wherein the force required to disengage the second locking element from the first locking element is greater than the force required to move the second locking element between the first articulated configuration and the second articulated configuration.

48. The article of footwear of claim 47, wherein the second locking element is configured to ride on the surface during movement of the heel sole portion between the first and the second articulated configurations.

49. The article of footwear of claim 42, wherein the articulation assembly further includes a biasing element configured to translationally bias the heel sole portion relative to the forefoot sole portion.

* * * * *